United States Patent [19]

Anderson et al.

[11] 4,108,026

[45] Aug. 22, 1978

[54] TOOL FOR REMOVING ROCK CLIMBING CAPTIVE DEVICES

[76] Inventors: Gordon K. Anderson, 14632 Pacific St.; Steven M. Leuck, 14801 Briarcliff Pl., both of Tustin, Calif. 92680; Gary L. Ruhl, 104 Crescent Dr., Ft. Scott, Kans. 66701

[21] Appl. No.: 801,852

[22] Filed: May 31, 1977

[51] Int. Cl.[2] ..... B25B 9/00

[52] U.S. Cl. ..... 81/3 R

[58] Field of Search ..... 81/3 R, 3 J

[56] References Cited

U.S. PATENT DOCUMENTS

| | | | |
|---|---|---|---|
| 1,521,265 | 12/1924 | Anderson | 81/3 R |
| 1,740,158 | 12/1929 | Dinklage | 81/3 R |
| 3,841,176 | 10/1974 | Murphy | 81/3 R |
| 4,001,903 | 1/1977 | Hay | 81/3 R X |

*Primary Examiner*—James L. Jones, Jr.
*Assistant Examiner*—James G. Smith

[57] ABSTRACT

A simple one-piece, hand held tool for repeatedly removing captive devices used in rock climbing, i.e. jam nuts, stoppers, wedges, chocks, tees, etc. This is a manual operated metallic tool consisting of a handle portion with a plurality of weight reducing and attaching holes covered with a non-metallic resilient material with laterial appertenances symmetrically located, conforming to the users hand with the shank tapered leading to the tip consisting of an offset appendage, with a radiused recess and a flat 90° perpendicular to the shank forming a hook and a dished end, used to both pull or push a lodged climbing devices positioned in a rock fissures.

3 Claims, 5 Drawing Figures

TOOL FOR REMOVING ROCK CLIMBING CAPTIVE DEVICES

This invention relates to certain new improvements in an integral hand held tool, which is designed and adapted for repeated use and is unique in that it lends itself to use when called upon to dislodge and remove captive devices, such as jam nuts, irregular hex nuts, stoppers, wedges, chocks, bongs, etc., used in so called "rock climbing" that have been positioned and placed in the fissure or cleft of a rock to support human weight and integrety of life with safety paraphernalia.

The main object of the invention is in the provision of the novel hand held, hooked end tool, comprised substantially of a metallic, rigid, flat structure, that allows the user to insert the shank into narrow cracks and crevices, and through manual manipulation, attach the offset hook portion to the said climbing device and withdraw it from its lodged position.

Another object of the invention, through the novel long, thin shank and flatened radiused recessed tip allows the user to push or reposition the climbing device, and with its radiused handle end, application of force may be realized by striking the base of the handle with the hand or a heavy object further transmitting the impact load to the wedged device, freeing it from its position. The configuration and strength of material allow the invention to be used as a lever in conjunction with a fulcrum in either the horizontal or vertical plane, further accomplishing its said purpose.

Yet another object of the invention is the unique configuration of the tip with the flat of the appendage at right angles to the shank, extending the proper distance to allow the tool to contact the captive device on two surfaces and allow sufficient friction to orient the climbing device. Also, the radiused opening at the apex of the appendage and shank allows the tool to affix itself to wires, cables and fibre lines attached to the climbing devices. The extreme end of the tool includes a concave surface comprising the outer extreme of the hook shaped appendage, which allows a non-slip bearing surface for applying pressure in a longitudinal direction, increasing the flexibility of the tool to not only pull but push the lodged device from its fixed position.

Still another object of the present invention provides an easily held handle conforming to the human hand, or hands, in shape with an increased width in the center, tapering to both ends with lateral appertenances symetrically located beyond the width of the hand, providing a non-slip pommel and for exerting pressure in either direction while in use. A row of symetrically located plurality of holes provide weight reducing effect and the rear hole, or holes, may be used for attachment to the users person with a carabiner, clip, thong, rope, ribbon, etc. The entire handle area contains a covering of non-metallic resilient, synthetic material that adheres to the surface of the metal protecting the users hand from any sharp edges and increasing the thickness for comfort, also, in providing a pleasing cosmetic effect to the overall configuration.

These and other objects and advantages of the present invention will become apparent from the subsequent detailed description of the preferred embodiment and the appended claims taken in conjunction with the accompanying drawings in which:

Figure 1:
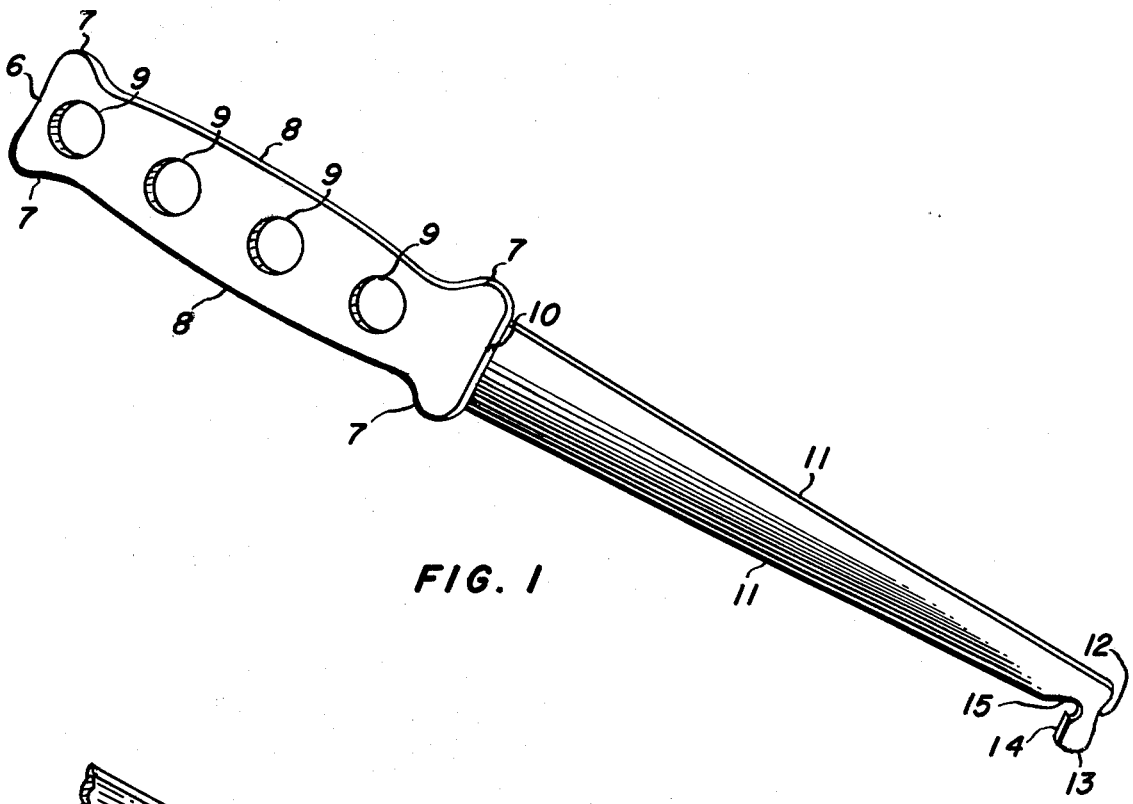
FIG. 1 is a side view of the present invention in partial perspective.

Referring now, in detail, to the drawings and describing the preferred embodiment of the invention which consists of a metal structure, substantially flat and rigid with a handle on the rearward end, consisting of a recessed or dished, concave end 6, allowing a non-slip base to drive the tool forward with the users hand or external source. The handle also consists of a plurality of laterial appertenances 7, located on said handle at the rear outward edge and at the forward handle outward section, providing obstacles to contain the users hand, also directly opposed symetrical radiused convex appendages 8 in the center of the handle, conforming to the users palm. A plurality of aligned holes located longitudinaly in said handle provide a lightening effect and an external fastening interface. A non-metallic, resilient, synthetic coating encompasses the entire handle area 10, providing gripping surface and a pleasing cosmetic effect.

The shank 11 is comprised of a tapered, elongated, straight, flat section the approximate width of the narrowest part of the handle, tapering to the forward tip with both sides straight 11, providing an extension from the handle to the tip, the approximate length of a present "state of the art" climbing device with a stranded wire rope, metallic attachment.

The forward tip end contains a small, recessed, concave surface at the extreme end of tool 12 to be utilized in longitudinal movement of the invention to reposition, or dislodge, the said captive devices from their fixed position. The offset appendage 13 on the tip protrudes laterally from the shank at right angles and forms a hook 14 with a flat surface. The said angle is 90° from the shank to the appendage 11 and 14. A small radiused opening 15 at the apex of the said right angle, intersecting the shank and the appendage, allows the tool to affix itself to the extension of a climbing device, such as a wire rope, non-metallic line, etc.

Figure 2:
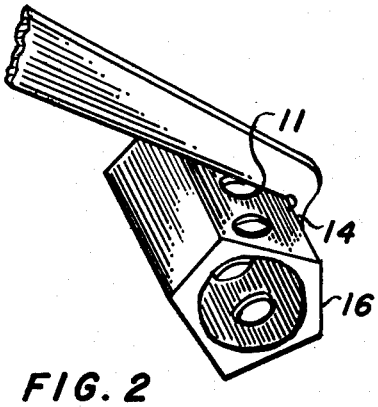
FIG. 2 shows in perspective, the placement of a portion of the tool on an irregular, hexagon climbing device preparatory to use.
Figure 3:
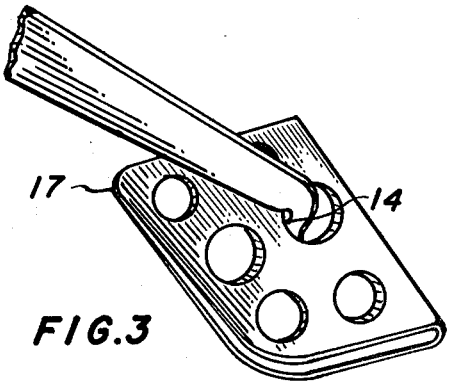
FIG. 3 shows in prespective, the placement of a portion of the tool on a so called "bong" climbing device preparatory to use.
Figure 4:
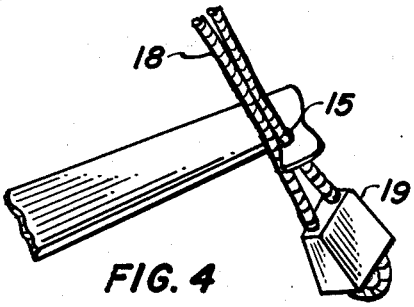
FIG. 4 shows in perspective, the placement of a portion of the tool on a wired, wedge climbing chock.
Figure 5:
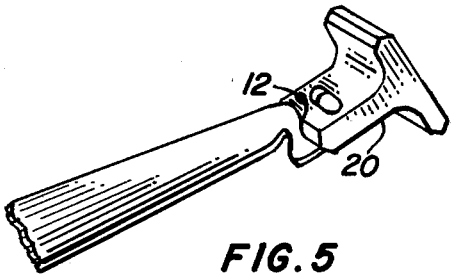
FIG. 5 shows in perspective, the placement of a portion of the tool on a "tee" shaped chock climbing device.

The application of the tool is depicted in FIGS. 2 through 5, indicating an eccentric irregular, hexagon shaped nut or so called wedge or jam nut 16 in contact with the tool, using the 90° right angle appendage 14 for surface contact. A metallic wedge device with a plurality of irregular holes, commonly known as a "bong" 17, may be dislodged by inserting the appendage 14 into a hole and either pushing or pulling the tool. A small wedge shaped climbing device utilizing a wire rope 18 known commonly as a "wired stopper" 19, may be removed by attaching the tool at the radiused opening 15 to the wire rope 18. The tool exerts force horizontally from the concave surface of the tip 12 to a tee shaped chock 20, providing a non-slip surface.

While the invention has been described in complete detail and pictorialy shown in the accompanying drawing, it is not to be limited to such details, since many changes and modifications may be in the invention without departing from the spirit and the scope thereof. Hence, it is described to cover any and all modifications and forms which may come within the language and scope of the appended claims.

We claim:

1. A tool for removing rock climbing captive devices comprising a substantially flat, rigid handle; a plurality of aligned holes spaced longitudinally along said handle; opposing lateral appertenances on the front and rear ends of the handle; a blade extending longitudinally from and integral with said front end of said handle; said blade being tapered away from said handle and including an offset hook on its end opposite the end integral with said handle; opposed recesses, one being at the junction of said blade and offset hook substantially facing said handle and the other being on the exterior of said hook facing in the longitudinal direction.

2. A tool according to claim 1 wherein said handle contains a covering of non-metallic resilient material over the entire surface thereof.

3. A tool according to claim 1 wherein said handle includes convex sides to conform to the palm of the user's hand.

* * * * *